United States Patent [19]

Biberian

[11] Patent Number: 4,884,010

[45] Date of Patent: Nov. 28, 1989

[54] ELECTRON-EMITTING DEVICE AND ITS APPLICATION PARTICULARLY TO MAKING FLAT TELEVISION SCREENS

[76] Inventor: Jean P. Biberian, 16 Impasse Mouillas, 13008 Marseille, France

[21] Appl. No.: 230,775

[22] Filed: Aug. 10, 1988

[51] Int. Cl.[4] ..... H01J 29/70; H01J 1/02; G09G 3/02

[52] U.S. Cl. ..... 315/366; 313/422; 313/309; 340/713

[58] Field of Search ..... 315/366, 382; 313/422, 313/309, 107, 302, 304, 307; 340/713, 719; 358/56

[56] References Cited

U.S. PATENT DOCUMENTS

| | | | |
|---|---|---|---|
| 3,882,355 | 5/1975 | De Witt | 340/713 |
| 4,020,381 | 4/1977 | Oess et al. | 313/309 |
| 4,654,649 | 3/1987 | Kojima et al. | 340/719 |

FOREIGN PATENT DOCUMENTS 2561019 7/1987 France .

*Primary Examiner*—Thomas H. Tarcza
*Assistant Examiner*—Gregory C. Issing
*Attorney, Agent, or Firm*—Browdy & Neimark

[57] ABSTRACT

A flat television screen, comprising several electron-emitting devices, each essentially consisting of an electric power supply connected to two plates of a capacitor supplying by one of these plates at least one field emission and an extraction grid placed close to the top of the field emission, the grid itself being connected to the other plate of the capacitor by a variable voltage generating device, these devices being connected together facing a fluorescent screen placed to receive a flow of electrons emitted by the field emission of each of the devices.

3 Claims, 1 Drawing Sheet

ELECTRON-EMITTING DEVICE AND ITS APPLICATION PARTICULARLY TO MAKING FLAT TELEVISION SCREENS

BACKGROUND OF THE INVENTION

1. Field of the Invention

This invention relates to an electron-emitting device and its application particularly to making flat television screens.

2. The Prior Art

At present, a certain number of electron-emitting devices are known, which are either hot cathodes where the electron emission is facilitated by thermal agitation or cathodes operating on the photoemission principle, or also sources of electrons created in a plasma discharge, or also by field emission tips, these tips being supplied directly by a electric power supply.

In numerous applications, there is an interest in point cold sources with a controlled amount of emitted electrons.

Known devices do not make it possible to obtain these results.

SUMMARY OF THE INVENTION

The present invention provides a simple device making it possible, on the one hand, to control the electron emission and, on the other hand, to cause this electron emission to be able to be performed sequentially and variably.

The device according to the invention essentially consists of a electric power supply connected to the two plates of a capacitor supplying, by one of these plates, at least one field emission tip and an extraction grid placed close to the top of this tip, said grid itself being connected to the other plate of the capacitor by a variable voltage generating device.

The invention also covers as an interesting application, that of such a device for making flat television screens.

According to this application, several devices according to the invention are connected together in series facing a fluorescent screen placed to receive the flow of electrons emitted by these devices.

BRIEF DESCRIPTION OF THE DRAWINGS

The interest and scope of the invention will come out more clearly from the following description given with reference to the accompanying drawings in which.

DETAILED DESCRIPTION OF THE PREFERRED EMBODIMENT

Figure 1:
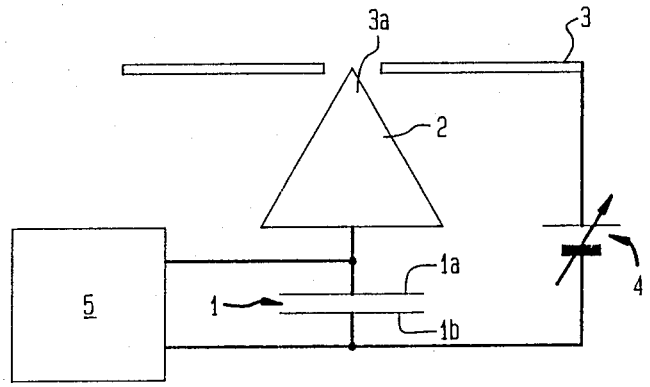
FIG. 1 is a diagrammatic view of a device according to the invention.

Referring to these figures, the device according to the invention (FIG. 1) comprises an electric power supply 5 with a programmable direct voltage, connected to the two plates of a capacitor 1.

Plate 1*a* of this capacitor 1 is connected to the base of at least one field emission tip 2 whose top is located close to orifice 3*a* of a plate, hereafter called grid 3. This grid itself is connected to the other plate 1*b* of capacitor 1 by variable voltage generator 4.

The device that has just been described functions as follows.

It operates cyclically, each cycle breaking down into two parts of equal or different duration. During the first part, generator 4 is brought to a zero or sufficiently low potential to prevent electron emission by tip 2. Electric power supply 5 provides an electric charge to capacitor 1.

During the second part, supply to the capacitor is interrupted by any means known in the art and generator 4 is brought to a sufficient potential to allow discharge of capacitor 1 through 2, thus providing the desired flow of electrons emitted through orifice 3*a* of grid 3. Once this flow is obtained, capacitor 1 is again supplied and the cycle described above is resumed.

Thus it can be seen that the device according to the invention not only makes it possible to obtain a given amount of electrons but also to control the frequency at which this amount is obtained, this frequency itself being a function of the supply frequency of capacitor 1.

Figure 2:
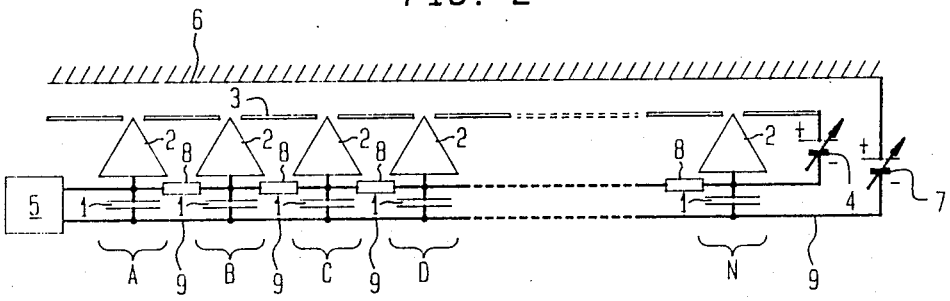
FIG. 2 is a diagram showing the application of several of these devices to making a flat television screen.

These properties then allow all types of applications in which it is desired to have a sequential flow of electrons of controlled intensity. Actually it suffices to have in rows and columns several devices of the type of that just described opposite a fluorescent screen like that illustrated in FIG. 2. In this figure can be seen a fluorescent flat screen 6 directly connected to electric power supply 5 by fixed voltage generator 7, the set of devices according to the invention A, B, C, D . . . N being connected together and in series, on the one hand, by a single line 9 and, on the other hand, by electronic devices 8 making it possible to isolate the charges of different capacitors 1. Moreover, voltage generator 4 is connected to grid 3 connected in series and to the devices 8 themselves connected in series.

Such an arrangement functions cyclically, each cycle being made up of two periods.

During the first period, electric power supply 5 supplies to capacitor 1 of device A the electric charge which is supposed to go into the capacitor of device N. This charge is then transferred into the capacitor of device B through one of electronic devices 8, then electric power supply 5 supplies to the capacitor of device A the electric charge corresponding to the capacitor of device N-1. The charges of capacitors B and A are then transferred in the same way to the capacitors of devices C and B and so on until the complete charging of the capacitors of the set of all the devices to device N. During all this first period, voltage generator 4 is put at zero or sufficiently low potential to prevent electron emission.

During the second period of the cycle, supply of the arrangement by electric power supply 5 is interrupted by means known in the art. Voltage generator 4 is then brought to a sufficient potential to allow simultaneous discharge of all the capacitors of devices A to N. The impact of the electrons emitted by each of tips 2 of each device A and N forms on screen 6, brought to a positive potential by voltage generator 7, an image whose intensity of each point depends on the charge accumulated on each capacitor. Once all the capacitors have been discharged, the cycle resumes as described above.

A number of the advantages obtained by the device according to the invention and in particular are as follows.

Regardless of the number of devices placed in rows or columns, their supply requires only a minimum number of connecting wires since each arrangement corresponds to a connection in series (connections 8 and 9 for each unit).

Further, the grids are all connected together, which simplifies the production of a television screen.

The potential applied to the grids can be high (several hundred volts) thus simplifying the switching problems, the frequency being able to be only 25 to 30 Hz.

Because of a high voltage that can be applied to the grids, the electrons can be extracted more easily and it is not necessary to have tip materials with low work function. It is thus possible to use materials less expensive than those usually used and the production of tips is less critical on the plate unit supporting them.

This new system make the television screen less sensitive to contamination of the tips and increases their life.

In the standard column line addressing, the light intensity is achieved by varying the voltage or current which is difficult to control. But by applying the device of the invention, the amount of the charge emitted creates the light intensity levels. These charges are thus perfectly controlled.

Finally, since any electronic equipment can be integrated on a tip support plate, it is possible to achieve screens by juxtaposing smaller unit modules of some square centimeters in surface, each of these modules being able to be connected to others, for example, by the back face of the circuit. There is no control electronic equipment on the edges of the screen which prevents them from being juxtaposed.

Further, it will be noted that to obtain color, it will suffice to use the tips existing on each of the assembled devices, making a screen by means of alternating red, green and blue bands. The bands of each color will then be connected together when the image of a given color is created, the corresponding band or its support being brought to a positive potential to accelerate the electrons, while the other two bands (or their supports) will be brought to a lower potential or a negative potential.

Of course, this invention was described only by way of pure explanatory example in no way limiting and any useful modification can be made thereto without going outside its scope.

I claim:

1. A flat television screen, comprising several electron-emitting devices, each essentially consisting of an electric power supply connected to two plates of a capacitor supplying by one of these plates at least one field emission tip and an extraction grid placed close to the top of the field emission tip, said grid itself being connected to the other plate of the capacitor by a variable voltage generating device, these devices being connected together facing a fluorescent screen placed to receive a flow of electrons emitted by the field emission tips of each of the devices.

2. An electron-emitting device comprising:

a capacitor having a first and second plate;

electric power supply means connected to said first and second plates of said capacitor for providing an electric charge to said capacitor;

a field emission tip connected to the first plate for selectively emitting electrons;

an extraction grid disposed adjacent to said field emission tip and connected to the second plate for receiving the electrons therefrom; and first variable voltage generating means connected between said grid and said second plate for selectively causing said field emission tip to emit the electrons.

3. A flat television screen comprising at least two of the electron-emitting devices of claim 2, wherein said power supply means comprises a single power supply and said first variable voltage generating means comprising a single variable voltage generating device, said television screen further comprising:

a single line connecting each of the at least two electron-emitting devices in series to each other and to said single power supply;

a fluorescent screen on which a television image is generated by the emitted electrons connected to said single line;

a second variable voltage generating means connected between said fluorescent screen and said single line for selectively bringing said fluorescent screen to a positive potential.

* * * * *